United States Patent [19]

Jira

[11] Patent Number: 4,753,183

[45] Date of Patent: Jun. 28, 1988

[54] DOUBLE BOOM RIGGED WINDSURFER

[76] Inventor: Antonin P. Jira, Weston, Ontario, Canada, M9R 1R6

[21] Appl. No.: 931,563

[22] Filed: Nov. 14, 1986

[51] Int. Cl.[4] ..... B63B 35/00

[52] U.S. Cl. ..... 114/39.2; 114/98

[58] Field of Search ..... 114/39, 39.1, 39.2, 114/98, 99, 102, 103, 43

[56] References Cited

U.S. PATENT DOCUMENTS

| | | | |
|---|---|---|---|
| 3,129,685 | 4/1964 | Kanser | 114/108 |
| 4,418,631 | 12/1983 | Frohbach | 114/39.2 |
| 4,436,047 | 3/1984 | Freyrie | 114/102 |

FOREIGN PATENT DOCUMENTS

| | | | |
|---|---|---|---|
| 2738374 | 3/1979 | Fed. Rep. of Germany | 114/39.2 |
| 3208340 | 9/1983 | Fed. Rep. of Germany | 114/39.2 |
| 3404181 | 8/1985 | Fed. Rep. of Germany | 114/103 |

*Primary Examiner*—Sherman D. Basinger
*Assistant Examiner*—Jesûs D. Sotelo
*Attorney, Agent, or Firm*—Donald E. Hewson

[57] ABSTRACT

Wind propelled apparatus employing a mast and a sail, in particular a windsurfer for boardsailing is provided with a first boom, rigged in the usual fashion, and also having a second boom of reduced length and span rigged below the first boom, for use by a child, simultaneously with an adult operating the first boom. This double boom rig permits a child to learn the sport, be it ice boating, skateboard sailing, or the preferred windsurfing, under truly live conditions, while overcoming the greatest, and virtually insurmountable problem of uphauling, when the spar and sail are hauled up out of the water into a sailing attitude. The sail window is extended downwardly, or a junior sail window can be provided at the appropriate height. The attachment of the second, small size JUNIOR (TM) boom can be effected by recessig the sail, or by use of a power clamp or power clamps to the spar or to the sail, or to both. In addition to providing first hand, realistic boardsailing, direct and effective communication between the child and the instructor is assured.

10 Claims, 4 Drawing Sheets

FIG.5c.
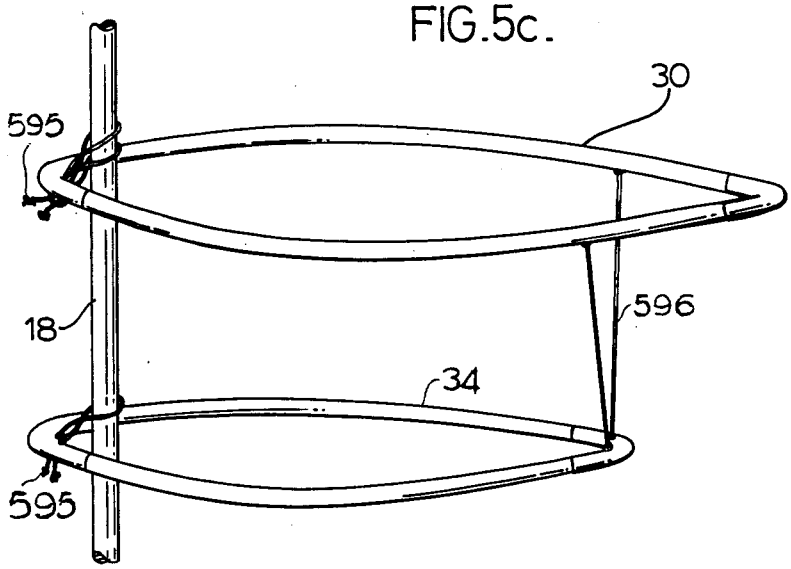
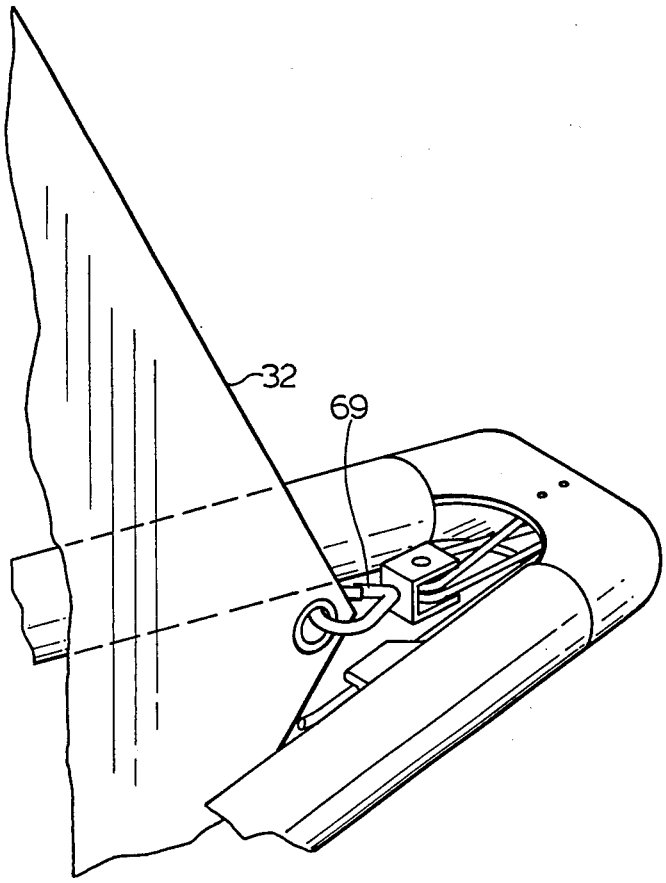
FIG.6.

DOUBLE BOOM RIGGED WINDSURFER

BACKGROUND OF THE INVENTION

This invention is directed to sail powered vehicles, in particular to a windsurfer for boardsailing, particularly a windsurfer rigged with a double boom, to permit the participation of a child in the sailing of a windsurfer, and to a sail adapted therefor.

Said propulsion is used both on water, on ice and on land as a means of propulsion, being usually practiced as a form of sport.

Boardsailing on windsurfers in particular has become a widely practiced sport, enjoying broad public support. However, in the case of most children a major problem has existed, in teaching the sport to a child in a safe and yet realistic manner. The use of land-based simulators is well known. However, these do not cater to the instinctive requirement of most youngsters to "get wet", and participate fully and immediately in the sport. Furthermore, these simulators do not have the feel of a surfboard, and the possibility of an injurious fall is always present.

Junior boards also are well known, namely smaller size windsurfers designed specifically for use by children. Such boards are satisfactory per se, but they do not approach the essential problems of safety, and of uphauling the spar and sail out of the water, which normally is a total impossibility for a young child to accomplish. Also, the requisite degree of control by a parent or instructor cannot be exercised, as the only effective means of communication is verbal, and the environmental background noises and other distractions often render verbal instructions quite ineffective in a high speed, potentially hazardous situation where conditions and situations can change very rapidly. Further, the exercise of direct physical control, which is very necessary in the case of a very young child, is totally precluded.

The eagerness of children to directly participate in board sailing often leads to them being carried as deck passengers on the windsurfer, which rules out the opportunity to experience the feel of handling the board, and which can present an inconvenience and impediment to the sailor as well as significantly change the handling characteristics of the board.

The present invention thus provides, in a wind propelled apparatus comprising body means adapted to support a plurality of users, a main spar secured by a pivotal joint to the body means, a sail and rigging therefor attached to the main spar, a master boom secured at the ends thereof and extending about the sail for use by a person of normal height, the improvement comprising a small size JUNIOR boom secured by the ends thereof and extending beneath the master boom and on both sides of the sail, to permit participatory use of the apparatus by an additional, smaller person. This arrangement normally permits of a range of height adjustment in accordance with the size of the child using the device.

There is further provided a sail having a first eyelet positioned for the attachment of a first boom thereto, and a second eyelet spaced therefrom for the attachment of a second boom thereto.

There is further provided sail window means located at a height commensurate with the JUNIOR boom, for use by the smaller person.

A further embodiment comprises a boom having a power appropriate to the occasion.

BRIEF DESCRIPTION OF THE DRAWINGS

Certain embodiments of the invention are described, reference being made to the accompanying drawings wherein:

FIG. 6 shown a boom sail aft attachment.

DETAILED DESCRIPTION OF THE EMBODIMENT

Figure 1:
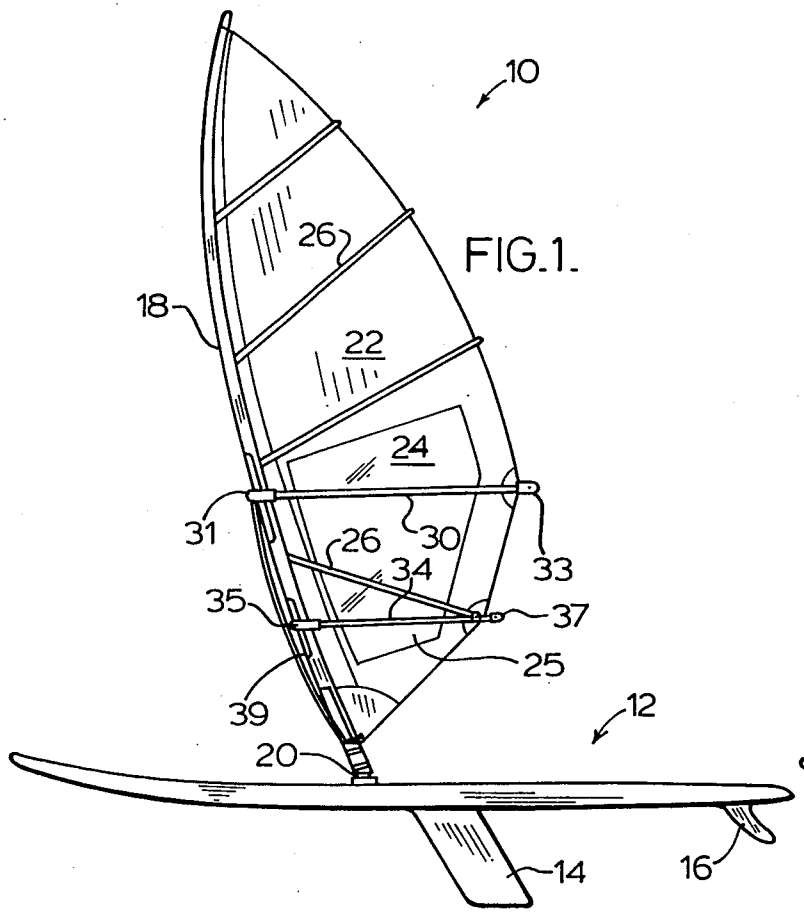
FIG. 1 is a side elevation of a windsurfer incorporating a first embodiment of the presently disclosed second boom, in a sailing stance.

Referring to FIG. 1, the windsurfer 10 has a hull 12, and is illustrated with daggerboard 14 and skeg 16. The main spar 18 is mounted in the usual fashion on a pivot 20, to permit collapse of the spar 18. A sail 22 having window 24 and slats 26 therein, is attached in the usual fashion to the main spar 18.

The window 24 is extending at 25 below the usual lower limit to give an extended range of vision therethrough.

A first boom 30 of the usual bifurcated construction is secured at its ends 31, 33 to the main spar and to the sail.

A second "junior" boom 34 is similarly secured at its ends 35, 37 so as to provide a second, sailing station for a small person such as a child.

The second sailing station is in general coincidence with the primary position, which is occupied by the sailor in charge of the windsurfer 10.

Figure 5A:
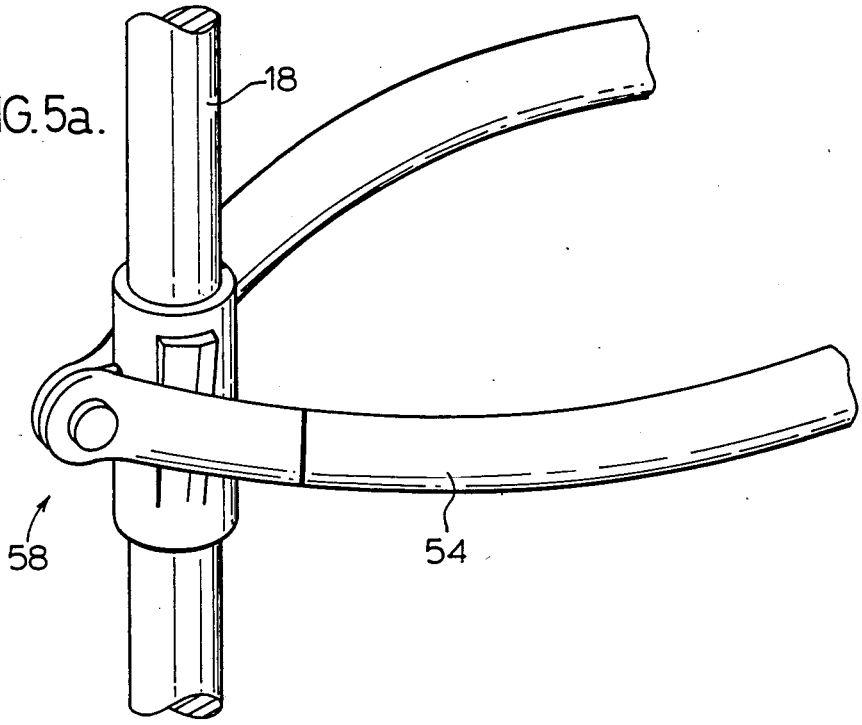
FIGS. 5*a, b* show quick release forward attachment.
Figure 5B:
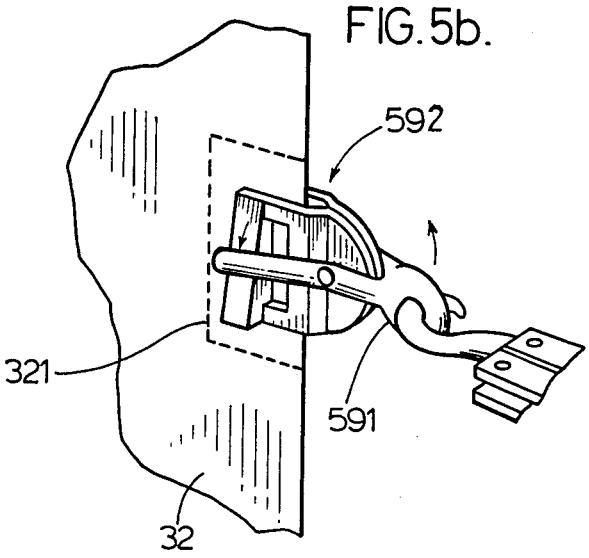
FIG. 5*c* is a general view showing an arrangement of the booms.

While attachment of the junior boom 34 is illustrated as employing a recess 35 in the leading edge of the sail 22, a power clamp shown schematically in FIGS. 5*a* and 5*b* may be used, to attach the JUNIOR boom 34 either to the spar 18 or to the sail 22, or both. The sail 22 may be provided with a reinforcement patch, to receive the jaws of the power clamp.

Figure 2:
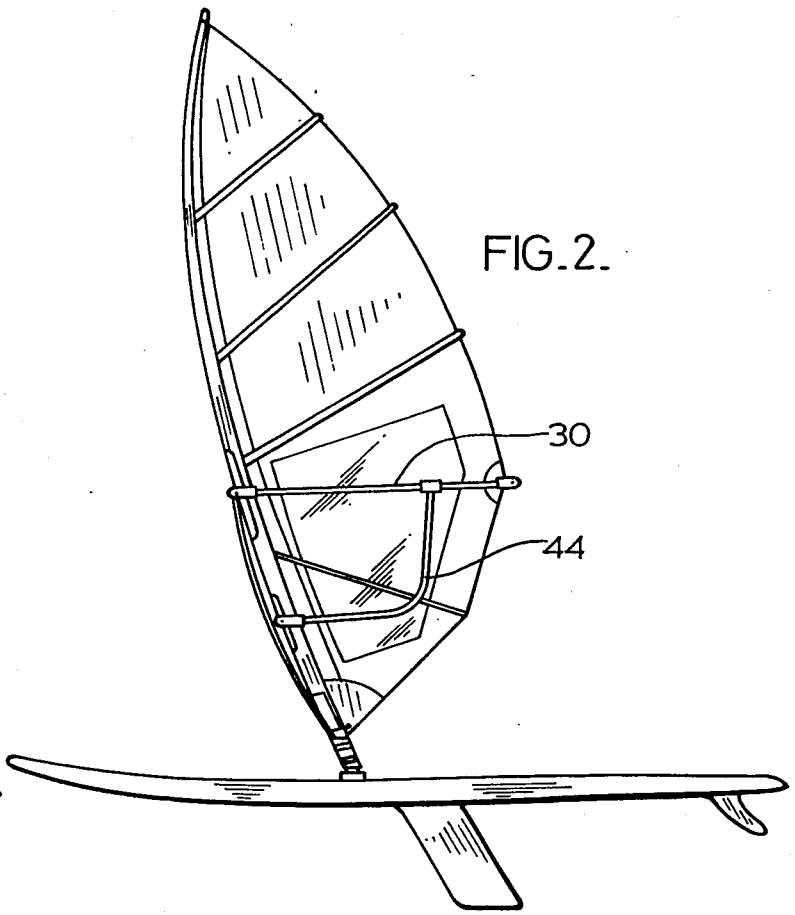
FIG. 2 is a like view showing a second embodiment.
Figure 3:
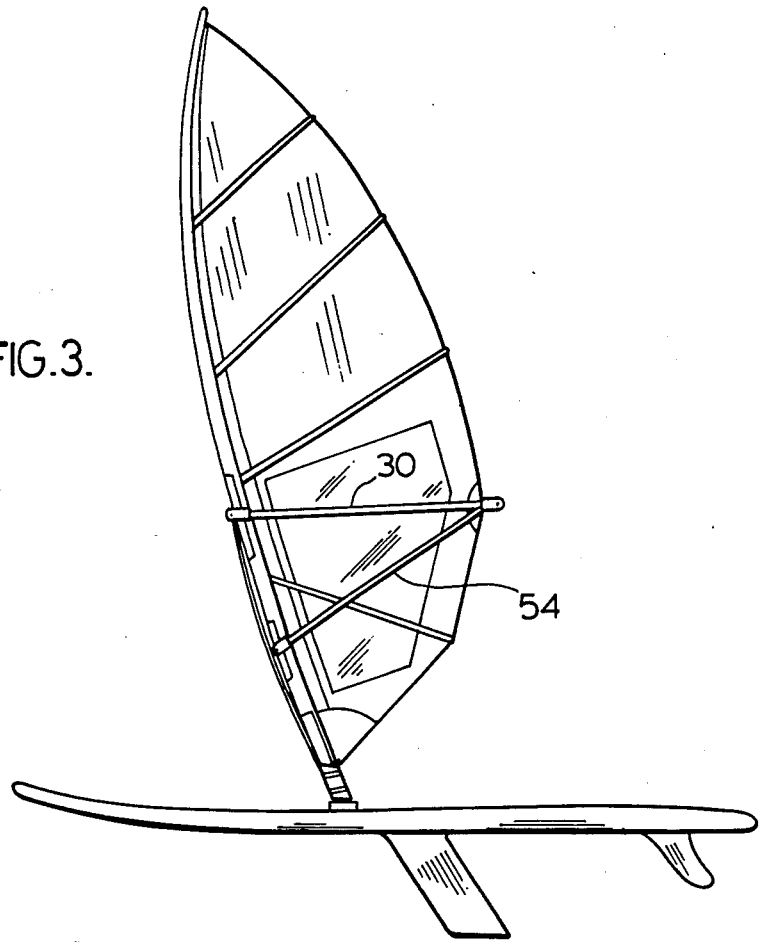
FIG. 3 is a like view showing a third embodiment.

Referring to FIGS. 2 and 3, the JUNIOR boom 44 or 54, respectively, is attached in depending relation from the first boom 30. However, in an alternative arrangement the forward end of the boom 44 can be mounted on an auxiliary rigid spar portion of the boom (not shown), either depending from the main boom 30, or extending upwardly in clamped relation from the main spar. From a safety point of view this auxiliary support spar portion can serve as an additional grab hold. The auxiliary mounting support can be of telescoped construction of adjustable length, to facilitate setting the JUNIOR boom to the most desireable height for the small user.

It will be understood that the window portion 25 may comprise a separate window.

Figure 4:
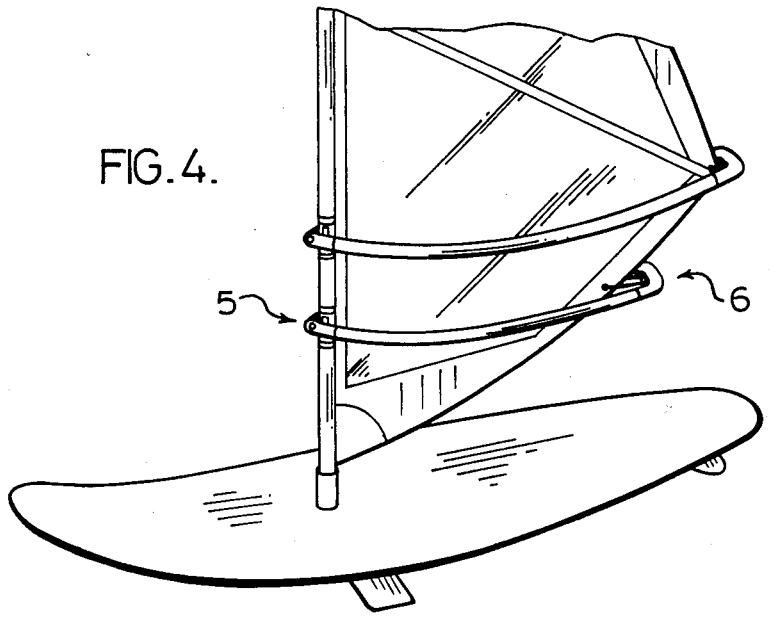
FIG. 4 is a general view of the subject windsurfer.

Referring to FIG. 4, it will be seen that the JUNIOR boom 34 is shorter and narrower, and generally of a smaller diameter tube, than the main boom 30.

Referring to the FIG. 5*a*, taken at the forward position 5 of FIG. 4, a power clamp 58 is secured to the forward end of the JUNIOR boom 54, and is clamped about the spar 18. With this type of power clamp in use, raising the boom 54 cams the opposed halves of the split clamp member into locking engagement with the spar 18. In the FIG. 5*b* embodiment, the power clamp is clamped to the sail 32, which has a suitable reinforcement patch 321 thereon. Displacement of the lever 591 upwardly, in the direction of the arrow, serves to cam the side plates 592 into gripping engagement with said 32.

In the FIG. 5*c* embodiment, the more usual lashing attachment is illustrated, comprising cords 595 looped about the spar 18, to secure the boom 34 thereto. The arrangement of the lashings relative to the respective booms can be arranged such that lowering of the "tail" of the main boom 30 serves to tension the main boom lashing to the spar 18, while raising of the lower or junior boom serves to tension the lower boom lashing to the spar 18. Such a lashing arrangement greatly facilitates adjustability and stability in respect of the roles played by the respective users. As illustrated, the lashings are in a non-operative non-tightened and untensioned condition.

Turning to FIG. 6, taken at location 6 of FIG. 4, an additional eyelet in the sail 32 receives the hook portion 69 of a conventional cordage rigging, for the after end of the JUNIOR or lower boom. The after end of the JUNIOR boom may also be secured by a power clamp similarly to the illustration of FIG. 5*b*.

While the illustrated embodiments all relate to board-sailing it will be appreciated that most aspects of the invention relate also to the other well known forms of wind propelled vehicles.

What is claimed is:

1. Wind-propelled apparatus comprising body means adapted to support a plurality of users, a main spar secured by a pivotal joint to the body means, and a sail and rigging therefor attached to the main spar;

a master boom associated at the forward end thereof with said main spar and extending about substantially the full width of the sail for use in direct manual handling by a first user in sailing the apparatus, to control the operation of the sail;

and a junior boom secured in supported relation at the ends thereof from the main spar and extending below said master boom on both sides of the sail for a major portion of the associated width of the sail, to permit the direct handling use of the apparatus by an additional, smaller person.

2. The apparatus of claim 1, adapted as a windsurfer.

3. The windsurfer as set forth in claim 2, including sail window means located at a height commensurate with said junior boom, for use by said smaller person.

4. The windsurfer as set forth in claim 2, wherein said junior boom extends in substantially parallel relation with said master boom.

5. The windsurfer as set forth in claim 2, wherein said junior boom extends in inclined relation from said spar to said master boom.

6. A sail for use with a wind propelled apparataus as set forth in claim 1, having a first eyelet at the after edge thereof for attachment of a main boom thereto, and a second eyelet at the after edge, spaced from and beneath said first eyelet, for attachment of said junior boom thereto.

7. The sail as set forth in claim 6, for use with a windsurfer.

8. A family windsurfer having a sailboard of appropriate buoyancy and deck area for use by at least two occupants;

a main spar pivotably secured to the sailboard;

a sail, and rigging therefor supported by the main spar;

an upper boom having a pair of outwardly bowed members encompassing the sail and extending from the main spar in a rearward direction;

a lower boom extending rearwardly and encompassing the width of the sail adjacent thereto, said lower boom having a pair of outwardly bowed members in mutually closer spaced relation than said upper boom members, to promote use thereof by a user standing closer to the sail than a user of the upper boom.

9. The windsurfer as set forth in claim 8, said lower boom having at least one quick release attachment means for securing the lower boom to the windsurfer.

10. The windsurfer as set forth in claim 9, said lower boom being rapidly detachable from said windsurfer by use of a pair of said quick release attachments.

* * * * *